US005141629A

United States Patent [19]

Pri-Bar et al.

[11] Patent Number: 5,141,629

[45] Date of Patent: Aug. 25, 1992

[54] PROCESS FOR THE DEHALOGENATION OF ORGANIC COMPOUNDS

[75] Inventors: Ilan Pri-Bar, Omer; David Azoulay, Beer-Sheva; Ouri Buchman, Omer, all of Israel

[73] Assignee: State of Israel, Atomic Energy Commission, Israel

[21] Appl. No.: 567,276

[22] Filed: Aug. 14, 1990

[30] Foreign Application Priority Data

May 15, 1990 [IL] Israel ..... 94397

[51] Int. Cl.[5] ..... C10G 19/02; C10G 27/00

[52] U.S. Cl. ..... 208/262.1; 208/262.5; 210/409; 585/469

[58] Field of Search ..... 208/262.1, 262.5; 210/409; 585/469

[56] References Cited

U.S. PATENT DOCUMENTS

| | | | |
|---|---|---|---|
| 3,595,931 | 7/1971 | Hay et al. | 260/668 |
| 4,315,718 | 4/1982 | Burnnelle | 208/262.5 |
| 4,327,027 | 4/1982 | Howard et al. | 208/262.5 |
| 4,337,368 | 6/1982 | Pytleueski et al. | 208/262.5 |
| 4,351,718 | 9/1982 | Brunnelle | 208/262 |
| 4,351,978 | 9/1982 | Hatano et al. | 208/262.5 |
| 4,410,422 | 10/1983 | Brunnelle | 208/262.5 |
| 4,435,379 | 3/1984 | Olson et al. | 423/472 |
| 4,447,541 | 5/1984 | Peterson | 208/262.5 |
| 4,618,686 | 10/1986 | Boyer | 549/360 |
| 4,631,183 | 12/1986 | Lalancette et al. | 423/659 |
| 4,755,628 | 7/1988 | Adams | 585/469 |
| 4,775,475 | 10/1988 | Johnson | 210/909 |
| 4,776,947 | 10/1988 | Streck et al. | 208/262.1 |
| 4,804,779 | 2/1989 | Novinson | 560/542 |
| 4,818,368 | 4/1989 | Kalnes et al. | 208/50 |
| 4,840,721 | 6/1989 | Kalnes et al. | 208/57 |
| 4,844,745 | 7/1989 | Nash et al. | 208/262.5 |
| 4,925,998 | 5/1990 | Abraham, Jr. et al. | 208/262.5 |
| 4,950,833 | 8/1990 | Hawari et al. | 208/262.5 |

FOREIGN PATENT DOCUMENTS

| | | | |
|---|---|---|---|
| 1185265 | 4/1985 | Canada . | |
| 60089 | 9/1982 | European Pat. Off. . | |
| 99951 | 2/1984 | European Pat. Off. . | |
| 140999 | 5/1985 | European Pat. Off. . | |
| 184342 | 6/1986 | European Pat. Off. . | |
| 306164 | 3/1989 | European Pat. Off. . | |
| 1136650 | 3/1977 | Japan | 208/262.5 |
| 2189804 | 11/1987 | United Kingdom . | |

OTHER PUBLICATIONS

A. Kuchen et al., *Fresenius Z Anal. Chem.*, 326 747, (1987).

N. I. Sax and R. J. Lewis, Revisors, *Hawley's Condensed Chemical Dictionary*, (eleventh edition), Van Nostrand Reinhold Company, New York (year).

"Analysts Comb Soil for PCBs" *New Scientist*, Oct. 14, 1989, p. 21.

*Primary Examiner*—Helane Myers

*Attorney, Agent, or Firm*—Merchant, Gould, Smith, Edell, Welter & Schmidt

[57] ABSTRACT

Organohalides are dehalogenated by bringing an organohalide or a mixture of two or more organohalides into contact with an alkali hydroxide in an alcoholic solution and in the presence of a catalytically effective amount of a heterogeneous transfer hydrogenolysis catalyst. The process can be carried out at relatively low temperatures (50°-150° C.) and at low pressures.

13 Claims, 2 Drawing Sheets

PROCESS FOR THE DEHALOGENATION OF ORGANIC COMPOUNDS

FIELD OF THE INVENTION

The present invention relates to a process for the dehalogenation of organic compounds. More particularly, the invention relates to the degradation and detoxification of organic compounds containing halogen atoms.

BACKGROUND OF THE INVENTION

Organic halogenated compounds are obtained in relatively large amounts as by-products of various industrial processes. Representative—but not limitative—examples of such compounds as chloro- or bromo-aromatic compounds, such as polychlorinated and polybrominated biphenyls (PCBs and PBBs), polychloro heterocyclic compounds, such as p-hexachlorocyclohexane, and organic solvents such as chlorobenzene. These products are toxic and hazardous, and must be disposed of in an effective manner.

Disposal of PCBs by incineration is expensive, due to the thermal stability of these compounds and it is complicated because highly toxic substances, such as 2,3,7,8-tetrachlorodibenzo-p-dioxin may be emitted during the process. Only a few specialized incinerators are licensed to handle such dangerous materials, and the facilities in which these processes are carried out are accused of causing environmental pollution [New Scientist, Oct. 14, 1989]. Because of these problems, many efforts have been made in the art to develop effective and safe processes for the chemical degradation of halogenated organic compounds, especially PCBs.

THE PRIOR ART

Many processes have been provided in the art, including processes for the chemical treatment and reclamation of oils and liquids containing various quantities of halogenated hydrocarbons. Processes of this type can be divided into two main categories. The first type of process includes the reductive dehalogenation, wherein the organic substances are treated with hydrogen gas (e.g., U.S. Pat. Nos. 4,840,721, 4,818,368, EP 306,164 and EP 299,149), or with other hydrogen donating compounds such as alkali hydride (GB 2,189,804), hypophosphite (U.S. Pat. No. 4,618,686), sodium borohydride (U.S. Pat. No. 4,804,779). These processes present several severe drawbacks, because they usually involve either complicated hydrogenation processes using explosive gases at high temperatures and pressures, which must be performed in specially designed reactors, or they involve the use of special reagents which are unfavored in industry for economical and safety reasons. Furthermore, HCl is produced in the process, which, as will be apparent to a skilled chemist, represents an added complication.

The second type of dehalogenation processes involves the reactions of metals, alkali earth metals, alkali metals, or compounds of these metals which are chemically capable of causing the degradation of a carbon-halogen bond, and which lead to the transformation of the organic halogen into an inorganic halogen bonded to the metal. Some examples of such processes are the use of metal or metals compounds such as tin, lead, aluminum, chloroaluminates, titanium, aluminum oxide, etc. (EP 277,858, EP 184,342 and U.S. Pat. No. 4,435,379). The most used compounds are alkali metals and alkali metal compounds such as sodium/sodium hydroxide (U.S. Pat. No. 4,755,628, CA 1,185,265 and EP 99,951), sodium naphthalene, sodium polyethylene glycol (EP 140,999 and EP 60,089), sodium carbonate, bicarbonate, alcoholates, etc. (U.S. Pat. No. 4,631,183 and EP 306,398).

Processes of this type also present considerable drawbacks. For the less reactive metals, dehalogenation usually involves high temperatures, in the order of 500°-1000° C., which are needed for the cleavage of the stable carbon-chlorine bond, and for the purpose of bringing the metal into contact with the organic compound in the form of molten salt, fine dispersion, etc.

Active metallic compounds, on the other hand, may react at lower temperatures, in the order of 300°-600° C. However, a large excess of expensive reagents are needed, and the process involves separation and purification steps which render it both complicated and expensive.

Metallic compounds capable of inducing the dehalogenation at low temperatures are very reactive, and therefore their handling and use are limited by the need for rigorous anhydrous conditions and inert atmosphere, which are required to avoid the danger of uncontrolled exothermic decomposition of these compounds. These processes, therefore, are highly hazardous and expensive.

It is therefore clear that it would be highly desirable to provide a process for the dehalogenation of waste organic compounds which is both simple and inexpensive.

SUMMARY OF THE INVENTION

It is an object of the present invention to provide such a process, which overcomes the drawbacks of the prior art, which does not require specially designed equipment, which is simple, inexpensive and non-hazardous.

The process for the dehalogenation of organohalides according to the invention comprises reacting an organohalide or a mixture of two or more organohalides with an alkali hydroxide in an alcoholic solution and in the presence of a catalytically effective amount of a heterogeneous transfer hydrogenolysis catalyst. The process is conducted without the introduction of gaseous hydrogen in excess of that contained in ambient atmosphere.

DETAILED DESCRIPTION OF THE INVENTION AND DRAWINGS

Figure 1:
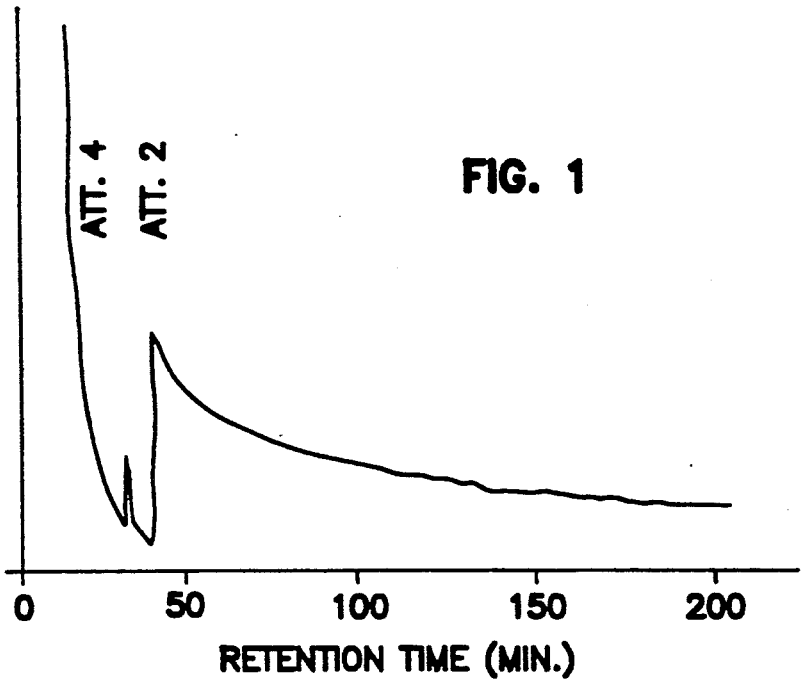
FIG. 1 is a chromatogram discussed in Example 1 below, reflecting GC analysis of a dehalogenated reaction mixture prepared in that example.

Preferably, the alcohol found in the alcoholic solution is a lower alcohol. The preferred alkali hydroxide is sodium or potassium hydroxide, although of course other hydroxides may be employed.

As to the catalyst, any transfer hydrogenolysis catalyst may be employed, as long as a catalytically effective amount is provided. A preferred catalyst would be, e.g., palladium-on-carbon. This catalyst is usually provided as 5% or 10% palladium-on-carbon.

The process of the invention is very convenient as far as temperatures are concerned. Preferred reaction temperatures are comprised between 50° and 150° C. Although higher temperatures could be employed, this is generally not required. Likewise, the reaction can proceed at low pressures, e.g., atmospheric pressure in an open vessel. Normally it will be preferred to carry out the reaction in a closed reactor at pressures lower than 3-4 atmospheres. This, as will be apparent to a skilled person, is a considerable advantage over the prior art, which requires considerably higher temperatures and pressures.

Furthermore, the process of the invention does not require anhydrous conditions and may be conveniently carried out in the presence of high water concentrations (e.g., 25%). This is an additional advantage of the invention, since anhydrous conditions require efforts and expenses.

Preferably, the concentration of the organohalides in the reaction mixture is comprised between 0.1-10% of the reaction mixture, and the alkali hydroxide is present in a stoichiometric excess over the organohalides. Usually, the concentration of organohalides remaining in the reaction mixture under normal conditions is lower than the detection limits.

The catalyst used in the reaction can be quantitively recovered after completion of the reaction, washed with water, and reused in a subsequent reaction. Therefore, this process is highly efficient also from the point of view of catalyst usage.

The invention also encompasses a process for the purification and the reclamation of fluids which are contaminated with organohalides, which process comprises contacting the fluid to be purified with a stoichiometric excess of an alkali hydroxide, with respect to the organohalide, in an alcoholic solution and in the presence of a catalytically effective amount of a heterogeneous transfer hydrogenolysis catalyst. Examples of such contaminated fluids are, e.g., mineral oils, silicon oils, lube oils, gas oils, transformation oils, which may be contaminated, e.g., with chlorinated organic compounds in a concentration range of about 0.1-60%.

The above and other characteristics and advantages of the invention will now be better understood through the following illustrative and non-limitative examples of preferred embodiments thereof. In the following examples a commercial dielectric liquid "Pyralene" was used to determine the effectiveness of the process. "Pyralene" is a trade name for a dielectric fluid produced by "Progil Fabrique-France". Pyralene contains about 40% by weight trichlorobenzene and 60% PCBs mixture. Total chlorine contents in Pyralene is approximately 60%. Quantification of total PCB contents in Pyralene was performed according to the method of A. Kuchen, O. Blaster and B. Marek [Fresenius Z. Anal. Chem., 326, 747 (1987)], using sodium aluminum hydride for analytical reductive dehalogenation. A value of 22% by weight of dehalogenated biphenyl was obtained.

EXAMPLE 1

0.2 ml, 286 mg Pyralene, 780 mg sodium hydroxide (19.5 mmol) and 30 mg palladium on carbon 10% (0.03 mA palladium) were placed in a glass reactor and 2.5 ml methanol were added. The reactor was purged twice with nitrogen, sealed and heated to 100° C. for 16 hours. At the conclusion of the reaction, the catalyst was separated by filtration or centrifugation, washed with tetrahydrofuran (THF) and methanol, and the combined filtrates were subjected to GC and HPLC analysis.

Figure 2:
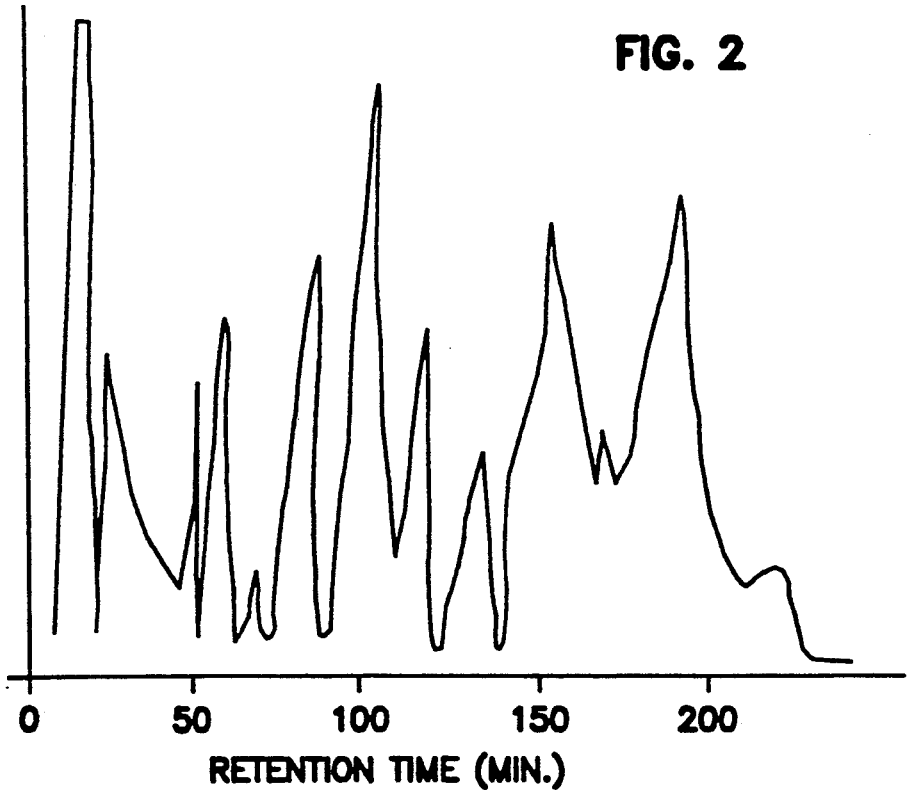
FIG. 2 is a chromatogram referred to in Example 1, reflecting GC analysis of a 12 ppm solution of Pyralene.

No observable remainder of Pyralene were detected. Organic products were mainly benzene and biphenyl (68 mg, 24.5% weight of starting Pyralene) indicating total dehalogenation of PCBs, based on dechlorination quantification. The dehalogenated reaction mixture was subjected to GC analysis using EC detector. The chromatogram (FIG. 1) reveals that none of the components of the starting Pyralene remained in any detectable amount after the dehalogenation. The chromatogram of 12 ppm solution of Pyralene (FIG. 2) consists of 8-10 components with retention times of 43-206 min. Taking into account that 10% of these components would still be observable, one can conclude that the concentration of Pyralene components dropped from 120,000 ppm to less than 1.0 ppm, which means over 99.999% decomposition.

EXAMPLE 2

Example 1 was repeated but without introduction of catalyst. No change in the starting Pyralene was observed in GC-EC analysis and no biphenyl was detected, as observed in GC-FID and HPLC analysis.

EXAMPLE 3

Example 1 was repeated but without nitrogen purging. No residual Pyralene was observed, indicating less than 1.0 ppm PCBs contents. Biphenyl (24.5% weight) was determined by GC and HPLC, indicating total hydrogenolysis of PCBs.

EXAMPLE 4

Example 1 was repeated but 0.25 ml water was introduced in addition to the methanol. Biphenyl (25% weight) was determined after the reaction was concluded. GC analysis revealed that no residual Pyralene components were left. A sole product with low retention time (20 min.) was detected in a concentration scale 1/10,000 lower than the starting Pyralene.

EXAMPLE 5

1 ml (1.475 gr) of Pyralene, 3.6 gr sodium hydroxide (90 mmol) and 50 mg palladium on carbon 10% were placed in a 100 ml flask provided with a magnetic stirrer and a reflux condenser. 8 ml methanol and 2 ml water were added and the mixture was heated with stirring to 80° C. for 18 hours. At the conclusion of the reaction the catalyst was separated and the filtrate was analyzed by GC.

No observable remainders of Pyralene were detected by GC-EC detector. Traces of products with lower retention times were detected. After completion of the reaction, 385 mg of biphenyl (26%) were found in the mixture by GC analysis.

EXAMPLE 6

Catalyst from example 5 was washed with water and with THF and then dried under vacuum at 100° C. to constant weight (57 mg). This catalyst was added together with 1.54 gr Pyralene, 3.6 gr sodium hydroxide, 10 ml methanol and 2 ml water into the reaction flask. The mixture was heated to 80° C. for 18 hours.

At the conclusion of the reaction 308 mg biphenyl (20% weight) were determined in the mixture, indicating that the recycled catalyst is effective.

EXAMPLE 7

Reclamation of Mineral Oil

Example 1 was repeated but 0.5 ml mineral oil contaminated with 0.2 ml (280 mg) Pyralene were added to the dehalogenation mixture. After completion of the reaction, the oil was separated from the methanol by means of phase separation. The solid was washed with methanol and the combined methanol fractions were subjected to GC and HPLC analysis. The oil phase was dissolved in THF and was subjected to GC and HPLC analysis.

No observable remainders of Pyralene were detected in the solutions. Organic products contain mainly benzene and biphenyl (68.6 mg), 24.5% weight of starting Pyralene.

EXAMPLES 8-20

Various halogenated compounds were dehalogenated according to the following procedure.

Halogenated compound (1 mmol), 0.72 gr sodium hydroxide (18 mmol), and 10 mg 10% palladium on carbon (0.01 mAtom Pd) were placed in a glass reactor, and 2.5 ml of methanol were added to this mixture. The reactor was purged twice with nitrogen, sealed and heated to 100° C. for 16 hours.

The results of these reactions are summarized in Table I below.

EXAMPLE 21

Example 1 was repeated, but with 1 gr (18 mmol) of potassium hydroxide as a base. After the conclusion of the reaction, no residual Pyralene was detected by GC (EC detector) analysis. Biphenyl (70.5 mg, 24.5% weight) was determined by GC and HPLC, indicating a highly efficient dehalogenation reaction.

EXAMPLE 22

Example 1 was repeated but with 2.5 ml of ethanol as a hydrogen donor and solvent. After the conclusion of the reaction no observable remainders of Pyralene were detected in the solution, using GC (EC detector) analysis. Biphenyl (70.0 mg, 24.8 weight %) and benzene were the main organic products in the GC and HPLC analysis. An additional, unidentified minor organic product was eluted at lower retention time (24 min.) in GC analysis.

EXAMPLE 23

Defluorination of fluoroaromatic compounds also takes place using similar reaction conditions. For example, 190 mg (1 mmol) 4,4'-difluorobiphenyl was subjected to the reaction conditions described for Examples 8-20. However, a longer reaction time was needed. When the reaction was continued for 70 hr., no starting difluorobiphenyl was detected in the solution. 4-Fluorobiphenyl (17 mg, 0.1 mmol, 10%) and biphenyl (123 mg, 0.8 mmol) were determined by GC as sole products in the reaction.

In the described process the environmental considerations are satisfied with regard to high efficiency of PCBs destruction and also to the recycling or disposal of all other reagents involved in the process.

Dehalogenated organic products may be used as a source of heat and contribute to an additional energy credit of the process. Inorganic products are harmless salts such as sodium chloride and sodium formate. The latter is a useful and saleable product, and the resulting revenue may reduce operating costs.

Figure 3:
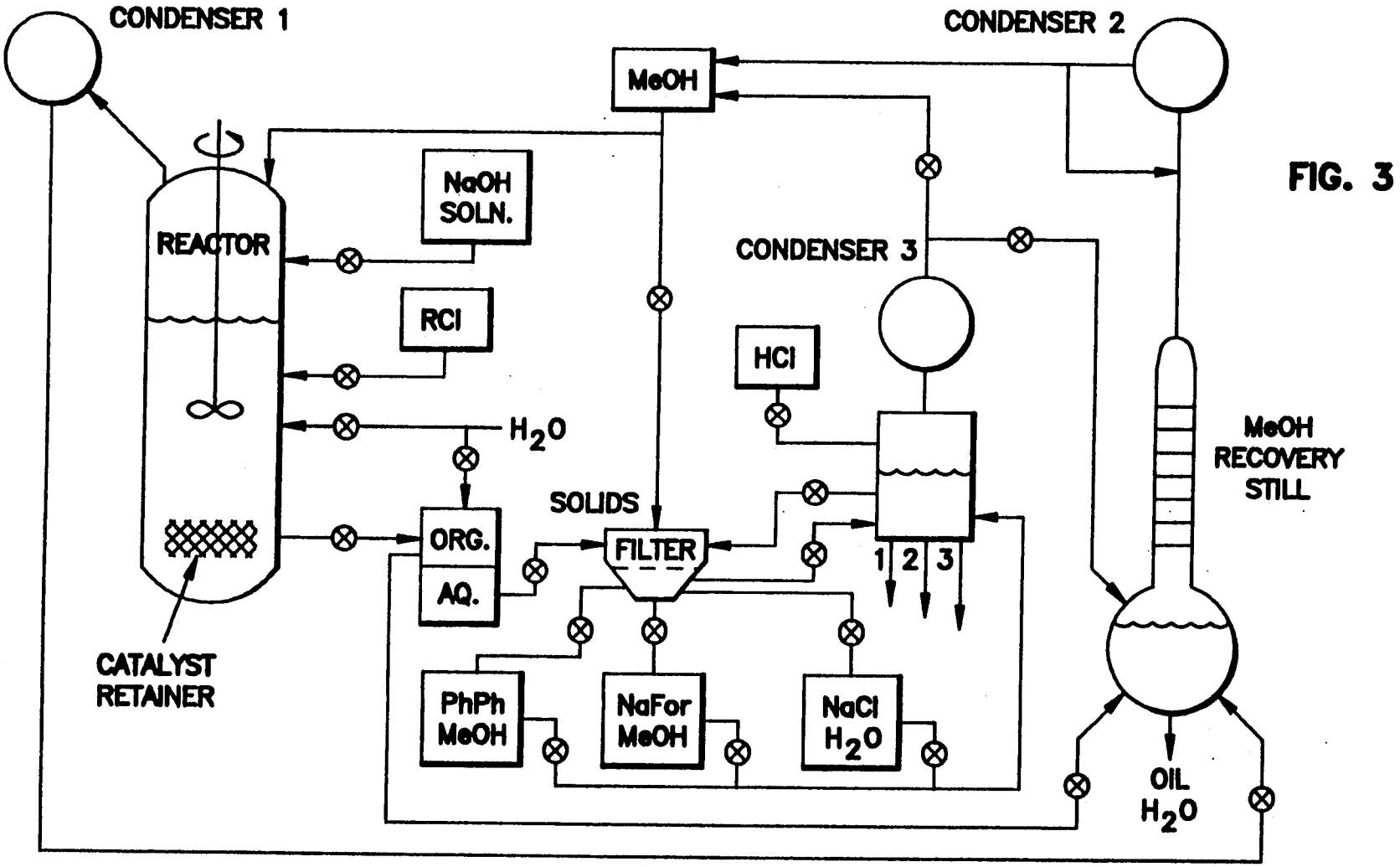
FIG. 3 is a schematic flow diagram for a dechlorination unit according to a process of the invention.

A schematic flow diagram for a dechlorination unit, according to one process of the invention, is shown in FIG. 3. The work-up process after the conclusion of the reaction starts with the evaporation of the solvents through condenser (1) and recycling the methanol using a solvent still and condenser (2). The non-volatile residue is washed with water into a liquid-liquid extraction unit, useful for the recovery of purified oils. The basic aqueous solution may be reused in the following dehalogenation process or may be neutralized with hydrochloric acid, followed by evaporation of water to dryness. Methanol is then added, allowing separation of soluble sodium formate from sodium chloride, which is disposed to waste.

The above description and examples have been provided for the purpose of illustration and are not meant to limit the invention. Many modifications can be effected in the process of the invention: for instance, various compounds can be dehalogenated using different catalysts, solvents and hydroxides, different reaction conditions can be used, or different fluids can be decontaminated, all without exceeding the scope of the invention.

TABLE I

| | | | treated sample ppm | | | |
|---|---|---|---|---|---|---|
| Example | compound | untreated sample/ppm | starting comp. | dihalo deriv. | monohalo deriv. | detection limits/ppm |
| 8 | $C_6H_5Cl$ | 45,000 | n.d. | — | n.d. | 10 |
| 9 | 1,2-$C_6H_4Cl_2$ | 60,000 | n.d. | n.d. | 100 | 10 |
| 10 | 1,3-$C_6H_4Cl_2$ | 60,000 | n.d. | n.d. | n.d. | 10 |
| 11 | 1,4-$C_6H_4Cl_2$ | 60,000 | n.d. | n.d. | n.d. | 10 |
| 12 | 1,2,3-$C_6H_3Cl_3$ | 180,000 | n.d. | n.d. | n.d. | 10 |
| 13 | 1,2,4-$C_6H_3Cl_3$ | 180,000 | n.d. | n.d. | n.d. | 10 |
| 14 | 1,3,5-$C_6H_3Cl_3$ | 180,000 | n.d. | n.d. | n.d. | 10 |
| 15 | hexachloro cyclohexane | 116,000 | n.d. | — | — | 10 |
| 16 | 1,2,3-$C_6H_3Cl_3$ in mineral oil (0.5 ml) | 180,000 | n.d. | n.d. | n.d. | 10 |
| 17 | 1-chloro-naphthalene | 66,000 | n.d. | — | n.d. | 1.0 |
| 18 | 4,4'-dichloro-biphenyl | 86,000 | n.d. | n.d. | n.d. | 1.0 |
| 19 | 1,4-$C_6H_4Br_2$ | 95,000 | n.d. | n.d. | n.d. | 10 |
| 20 | 4,4'-dibromo- | 125,000 | n.d. | n.d. | n.d. | 1.0 |

TABLE I-continued

| Example | compound | untreated sample/ppm | treated sample ppm starting comp. | dihalo deriv. | monohalo deriv. | detection limits/ppm |
|---|---|---|---|---|---|---|
| | biphenyl | | | | | |

n.d. = not detectable

We claim:

1. A process for the dehalogenation of organohalides wherein an organohalide or a mixture of two or more organohalides is brought into contact with an alkali hydroxide in an alcoholic solution and in the presence of a catalytically effective amount of a heterogeneous transfer hydrogenolysis catalyst, the reaction being carried out in a closed vessel under an inert atmosphere.

2. A process according to claim 1, wherein the closed vessel is purged with an inert gas before the reaction begins.

3. A process according to claim 2, wherein the inert gas is nitrogen.

4. A process according to claim 1, wherein the alcoholic solution comprises a lower alcohol.

5. A process according to claim 1, wherein the alkali hydroxide is selected from the group consisting essentially of sodium and potassium hydroxide.

6. A process according to claim 1, wherein the transfer hydrogenolysis catalyst is a palladium-on-carbon catalyst.

7. A process according to claim 1, wherein the dehalogenation reaction is carried out at a temperature comprised between about 50° C. and about 150° C.

8. A process according to claim 7, wherein the dehalogenation reaction is carried out at a pressure below about 4 atmospheres.

9. A process according to claim 1, wherein the concentration of the organohalides in the reaction mixture is comprised between 0.1-10% of the reaction mixture.

10. A process according to claim 1, wherein the reaction is continued until less than 10 ppm of organohalide remains in the reaction mixture.

11. A process according to claim 1, wherein the catalyst is recovered after completion of the reaction, washed and reused in a subsequent reaction.

12. A process for the purification and reclamation of fluids contaminated with organohalides, comprising contacting the fluid to be purified with a stoichiometric excess of an alkali hydroxide, with respect to the organohalide, in an alcoholic solution and in the presence of a catalytically effective amount of a heterogeneous transfer hydrogenolysis catalyst, the reaction being carried out in a closed vessel under an inert atmosphere.

13. A process according to claim 12, wherein the fluid to be purified comprises mineral oils, silicon oils, lube oils, gas oils, transformator oils and the like.

* * * * *

UNITED STATES PATENT AND TRADEMARK OFFICE

CERTIFICATE OF CORRECTION

PATENT NO. : 5,141,629

DATED : August 25, 1992

INVENTOR(S) : Ilan Pri-Bar et al.

It is certified that error appears in the above-identified patent and that said Letters Patent is hereby corrected as shown below:

At column 2, lines 44-47, delete "The process is conducted without the introduction of gaseous hydrogen in excess of that contained in ambient atmosphere." after --catalyst.--

Signed and Sealed this

Eighteenth Day of January, 1994

Bruce Lehman

*Attest:*

BRUCE LEHMAN

*Attesting Officer*

*Commissioner of Patents and Trademarks*